US006023835A

United States Patent [19]

Kircher et al.

[11] Patent Number: 6,023,835

[45] Date of Patent: Feb. 15, 2000

[54] PROCESS FOR PRODUCING THIN-HOT ROLLED STRIP

[75] Inventors: Werner Kircher, Ratingen; Peter Jollet, Düsseldorf, both of Germany

[73] Assignee: Mannesmann AG, Düsseldorf, Germany

[21] Appl. No.: 09/120,777

[22] Filed: Jul. 22, 1998

[30] Foreign Application Priority Data

Jul. 23, 1997 [DE] Germany ..... 197 32 538
Oct. 31, 1997 [DE] Germany ..... 197 49 716

[51] Int. Cl.[7] ..... B21B 27/06

[52] U.S. Cl. ..... 29/527.7; 72/202; 72/229

[58] Field of Search ..... 29/527.7; 72/202, 72/229, 366.2

[56] References Cited

U.S. PATENT DOCUMENTS

| | | | |
|---|---|---|---|
| 5,540,074 | 7/1996 | Smith et al. | 72/39 |
| 5,689,991 | 11/1997 | Kircher | 72/202 |
| 5,743,125 | 4/1998 | Kneppe et al. | 72/201 |
| 5,771,732 | 6/1998 | Kramer et al. | 72/202 |

FOREIGN PATENT DOCUMENTS

| | | |
|---|---|---|
| 0 460 655 | 6/1991 | European Pat. Off. . |
| 0 734 793 | 2/1996 | European Pat. Off. . |
| 0 761 326 | 8/1996 | European Pat. Off. . |
| 2 326 407 | 12/1974 | Germany . |
| 691 02 280 | 1/1992 | Germany . |
| 195 38 341 | 3/1997 | Germany . |
| WO 96/32509 | 10/1996 | WIPO . |
| WO 97/01401 | 1/1997 | WIPO . |

*Primary Examiner*—P. W. Echols
*Attorney, Agent, or Firm*—Cohen, Potani, Lieberman & Pavane

[57] ABSTRACT

The invention relates to a process for producing thin hot-rolled steel strip with a final thickness of <1 mm from strip-cast feedstock in sequential steps, including surface descaling a cast feedstock, rolling the feedstock in six passes in a tandem Steckel roll line, coiling and uncoiling the feedstock after its first and second passage through the tandem Steckel roll line in furnaces arranged on the entry and exit sides of the tandem Steckel roll line. After a third passage through the Steckel roll line, the feedstock is coiled up in an exit-side coiling device having two furnaces one atop the other, which serves as a storage device for the roughed strip. Simultaneously with the coiling of the first strip, a second strip is uncoiled from the storage device. The cropped front end of the second strip is welded to the cropped rear end of the already uncoiled roughed strip. After passing through a second roughed strip storage device, the roughed strip that has been welded into an endless strip is fed to the finishing train, where it is reduced to the desired finished strip thickness.

6 Claims, 1 Drawing Sheet

PROCESS FOR PRODUCING THIN-HOT ROLLED STRIP

BACKGROUND OF THE INVENTION

1. Field of the Invention

The invention relates to a process for producing thin hot-rolled steel strip with a final thickness of <1 mm from strip-cast feedstock in sequential steps, wherein the solidified feedstock leaving the casting machine is divided into roughed strip lengths, heated in a straight-flow furnace to roll temperature, and then rolled in a reverse-operated tandem Steckel roll line and in an attached finishing train.

2. Description of the Related Art

In prior art processes, the rolling of ferritic and steel strips to thicknesses of approximately 0.7 mm is performed by a continuous operation using rolling machines with a large number of stands and a correspondingly high investment cost. In the prior art, welding machines used to attach the roughed strips to each other to produce an endless strip move with the roughed strip at the entry speed of the roughed strip into the rolling mill so that the end of one roughed strip is attached to the beginning of another roughed strip without stopping production. The use of synchronously movable welding machines also leads to high expenses.

SUMMARY OF THE INVENTION

The object of the present invention is to provide a rolling mill for producing extremely thin finished strip, preferably having a thickness of approximately 0.5 mm, which achieves high capacity with few stands, thereby resulting in a low investment cost, and is used without capacity limitations for strips thicker than 1.2 mm.

To attain this object, the present invention comprises the following process steps:

a) after surface descaling of a strip-cast 90 mm thick feedstock, rolling the feedstock through six roll passes in a tandem Steckel roll line having two Steckel roll stands, wherein the feedstock completes two roll passes for each passage through the tandem Steckel roll line;

b) coiling and uncoiling a first feedstock strip in coiling furnaces arranged on the entry and exit sides of the tandem Steckel roll line after each of a first and a second passage of the first feedstock strip through the tandem Steckel roll line;

c) coiling the first feedstock strip after its third passage through the tandem Steckel roll line in one of two furnaces in an exit-side coiling device, wherein the two furnaces are arranged one atop the other and the exit-side coiling device is a storage device for the roughed strips;

d) uncoiling a second feedstock strip from the other of the two furnaces in the exit side coiling device simultaneously with the coiling of the first feedstock strip in the exit-side coiling device;

e) welding a cropped front end of the second feedstock strip to a cropped rear end of an already uncoiled roughed strip to create an endless strip;

f) feeding the endless strip to a finishing train for reducing the endless strip to a desired finished strip thickness.

Thus, according to the present invention, a slab of feedstock that is approximately 90 mm thick, or less, is produced from a casting machine and is divided at the exit of the casting machine by shears or other dividing devices into finite roughed strip lengths. The divided roughed strip lengths of the feedstock are evenly tempered by being passed through a furnace such, for example, as a rotary hearth furnace and are then fed, evenly tempered, to a roughing train. The roughing train includes a descaling device, a tandem Steckel roll line having two Steckel roll stands and with bilaterally arranged coiling furnaces or with a coiling device having two furnaces one atop the other, known as a Cremona box, attached directly to the exit-side of the tandem Steckel roll line. The Cremona box has upper and lower coiling devices, which may be alternately used.

The roughed strip length that exits the rotary hearth furnace is first descaled, and then reduced in thickness through the two Steckel roll stands of the tandem Steckel roll line to such an extent that it can be coiled in coiling furnaces arranged on the exit side. The next pass is carried out on the tandem Steckel roll line in reversed operation, whereby the roughed strip is fed to an entry-side coiling furnace. Before the second entry of the roughed strip onto the roll line, the surface may again be descaled. To prevent scale from being rolled into the material, descaling may also be performed before the final (third) reversing pass. In the third reversing pass, the strip again passes through the two Steckel roll stands of the tandem Steckel roll line toward a finishing train. The roughed strip has thus undergone a total of six reducing passes. After this, the exiting roughed strip is coiled up in one of the furnaces of the aforementioned "Cremona box."

It has proved advantageous to use one of the upper and lower coiling devices of the Cremona box as the exit-side coiling furnace after the first passage of the roughed strip through the tandem Steckel roll line instead of using a separate exit-side coiling furnace between the Steckel roll stands and the Cremona box. This allows the separate exit-side coiling furnace between the Steckel stands and the "Cremona box" to be dispensed with.

After the roughed strip has been coiled in either the upper or lower coiling device of the Cremona box, the furnace body is swivelled, and the roughed strip end, which now becomes the roughed strip head, is fed to a shears to have the head scrap cut off. The roughed strip is then passed through a welding machine (which welds the roughed strip head to a previously uncoiled roughed strip. The roughed strip is then supplied to a roughed strip storage device, at whose end is located a further descaling device to remove scale that has formed in the meantime.

Located directly behind the descaling device is a finishing mill train, which reduces the strip to a thickness that ensures the safe transport of the strip via the exit roller table to the coiler. In front of the coiler is a rapid cutting shears that, in the case of continuous rolling, later redivides the strips to attain the desired strip sizes and weights.

According to the invention, welding of the cropped roughed strips occurs at a stationary location. For this purpose, after the roughed strip has been taken by the coiler, the length of roughed strip needed for the welding of the second roughed strip to the first roughed strip during standstill is stored in the roughed strip storage device, such for example, as a loop tower, in front of the finishing train. Thus, while the first strip is rolled in the finishing train, the second roughed strip is simultaneously rolled in the roughing train and coiled up in the other of the lower and upper furnace of the Cremona box.

After the head scrap removal, the second roughed strip is welded by means of the welding machine to the end of the first roughed strip. During the welding procedure, the contents of the roughed strip storage device in front of the finishing train are fed to the finishing train, without the rolling process in the finishing train having to be interrupted. The upper furnace of the Cremona box, now empty, swivels back into the pick-up position to be ready to receive the third roughed strip, which has been produced simultaneously with the rolling process of the second strip into the finishing train.

As soon as the finished strip is clamped between the last active finishing stand and the coiler, the finished strip thickness can be reduced by adjustments of the finishing train, and the roll speed can be correspondingly increased. In this way, the goal of rolling 0.5 mm-thick hot strip at an austenitic temperature level is achieved.

The rapid cutting shears in front of the coiler enable the redivision of the endless strip to produce the desired coil size. During the passage of the second roughed strip through the finishing train, the storage device in front of the finishing train is again filled, to ensure the time needed to weld the next roughed strip to the roughed strip just rolled. This process occurs repeatedly with the same rhythm.

Preferably, the roughed strip storage device arranged directly in front of the finishing train is heated and protected by a protective gas. The capacity of the roughed strip storage device set in accordance with the exit speed of the finished strip and the time needed to weld the roughed strip ends.

If the process is terminated for any of various reasons, the finished strip thickness should again be brought to a size that permits easy tailing from the finishing train and secure transport via the exit roller table.

The invention creates, for the first time, a machine for producing extremely thin finished strip that has a high capacity and uses a low number of stands, thereby incurring a low capital investment. Moreover, when the welding machine and the storage device in front of the finishing train are not used, thicker strip sizes (thicker than 1.2 mm) may be produced without the capacity limitations associated with the welding machine and storage device. Therefore, according to another feature of the invention, it is proposed that the roughed strip be rolled in the tandem Steckel roll line in six passes to a thickness of, for example, 3 mm.

The casting machine capacity and the rolling capacities of the roughing and finishing trains are designed so that continuous operation is guaranteed and the desired thermal and geometric demands on the finished strip are met.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
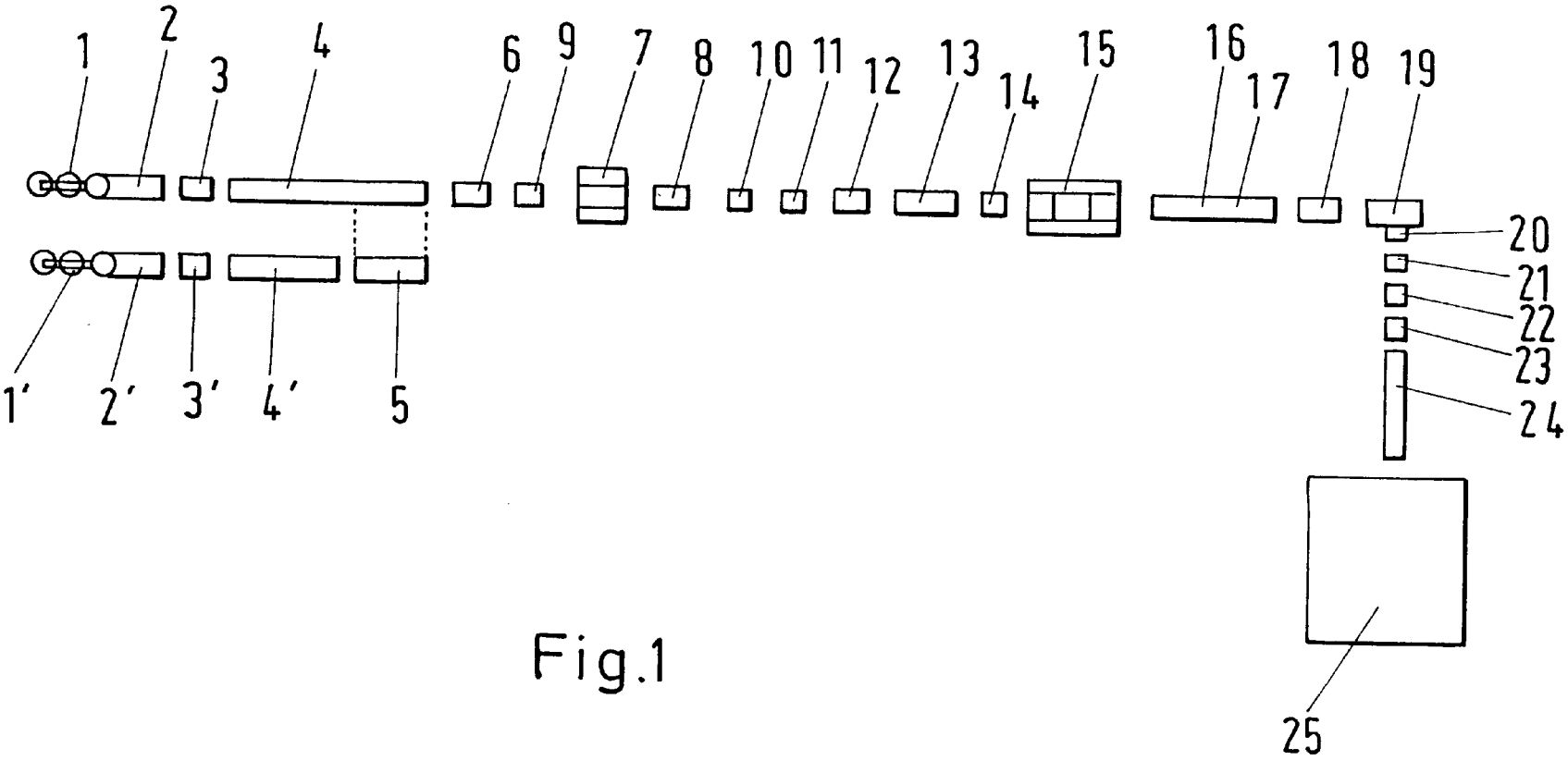
FIG. 1 is a schematic diagram depicting an entire roll train including a rolling machine for performing the method in accordance with the present invention.

The single FIG. 1 shows an entire roll train for rolling and finishing strip material comprising two ladle turning towers 1 and 1' arranged in front of two continuous casting machines 2 and 2' so that the ladle turning towers 1 and 1' respectively supply the continuous casting machine 2 and 2' with cast melt. The continuous casting machines 2 and 2', which are bow-type continuous casting machines in the preferred embodiment with a horizontal run-out, have flame cutting machines or shears 3 and 3' at their exit-side ends. Although bow-type continuous casting machines 2 and 2' are shown, other types of casting machines may also be used. The shears 3 and 3' divide slabs of the cast material into roughed strips. These roughed strips are fed into a rotary hearth furnace 4 and 4', where they are brought to an even temperature, i.e. tempered, over their cross-section. The roughed strips are transported by a ferry 5 to the beginning of a rolling mill line. The two casting machines 2 and 2' are thus connected to the rolling mill in this fashion. After passing through the rotary hearth furnace 4 and 4', the roughed strip is descaled in a scale washer 6 and fed to a tandem Steckel roll line 7 having two Steckel roll stands. Since the tandem Steckel roll line 7 has two roll stands, the roughed strip undergoes two roll passes for each passage through the tandem Steckel roll line 7. After its first passage through the tandem Steckel roll line 7, the roughed strip is coiled up in an exit-side coiling furnace 8. Subsequently, the roughed strip is further reduced in by a second passage through the tandem Steckel roll line 7 back toward the entrance of the roll line. After the second passage, the material is coiled up in an entry-side coiling furnace 9. The third passage through the roll line 7 reduces the material to a desired roughed strip thickness. This roughed strip is received and stored in a coiling device 10, which is a Cremona furnace comprising two furnaces arranged one atop the other, each of which is equipped with a coiling mandrel to hold the roughed strip. The housings of these furnaces can be swivelled to bring the end of the roughed strip into the correct position for the subsequent work steps. The furnaces 8 and 9 serve as storage devices to compensate for short process irregularities in the following machine sections and are also used, as needed, as "Steckel furnaces" after the first and second passages. In an optional embodiment, the exit-side coiling furnace 8 is omitted and one of the two furnaces of the coil storage device 10 is used instead of the exit-side coiling device 8. This embodiment simplifies the roughed strip rolling train.

The roughed strip is fed from alternating ones of the two furnaces of the coil storage device 10 to a shears 11, which crops the head of the roughed strip. The cropped roughed strip passes through a welding machine 12 where it is welded to the cropped end of a previously uncoiled roughed strip. The welded roughed strip is then fed through a looping tower 13 and a scale washer 14, and rolled in a multi-stand finishing train 15 into the desired finished strip. During the welding of the cropped rough strip, the looping tower 13 feeds stored roughed strip to the scale washer 14 and multistand finishing train 15 so that the finishing train is run without interruption. Once the weld is complete, the looping tower is re-filled for continuous feeding of the finishing train 15 during the next welding procedure.

After passing through the finishing train 15, the roughed strip runs through a rapid cutting shears 18 via an exit roller table 16 with an integrated strip cooling device 17 to a coiling device 19 where the roughed strip is coiled up. Coil removal carts 20 and other handling devices, such, for example, as a strapping machine 21, scales 22 and marking devices 23, follow the coiling device 19. The finished coil is transported from these handling devices by a coil transport device 24 to a coil storage area 25 and stored.

The invention is not limited by the embodiments described above which are presented as examples only but can be modified in various ways within the scope of protection defined by the appended patent claims.

We claim:

1. A process for producing a thin hot-rolled steel strip with a final thickness of less than 1 mm from a strip-cast feedstock, comprising the steps of:

a. dividing the feedstock leaving a casting machine into roughed strip lengths;

b. heating the roughed strip lengths to a roll temperature;

c. rolling the roughed strip lengths in six roll passes through a tandem Steckel roll line, wherein each passage through the tandem Steckel roll line comprises two roll passes;

d. coiling and uncoiling a first roughed strip length in an exit-side coiling furnace after a first passage of the first roughed strip through the tandem Steckel roll line;

e. coiling and uncoiling the first roughed strip length in an entry-side coiling furnace after a second passage of the first roughed strip through the tandem Steckel roll line;

f. coiling the first roughed strip length after a third passage of the first roughed strip length through the tandem Steckel roll line in one of two furnaces that are mounted one atop the other in another exit side coil storage device for storing the roughed strip lengths;

g. uncoiling a second roughed strip length from the other of the two furnaces of the exit side coiling device during said coiling of said first roughed strip length;

h. welding a cropped front end of the second roughed strip length to a cropped rear end of an already uncoiled roughed strip length to create an endless strip; and i. feeding the endless strip through a finishing train where the endless strip is reduced to a desired finished strip thickness of less than 1 mm.

2. The process of claim 1, wherein the exit-side coiling device in said step d. comprises one of the two furnaces used in said step f.

3. The process of claim 1, further comprising the step of feeding the already uncoiled roughed strip length to the finishing train from a coil storage device so that said step of welding is performed in a stationary manner.

4. The process of claim 1, wherein said step of feeding comprises feeding the endless strip through a heated roughed strip storage device and a finishing train, keeping the heated roughed strip storage device under protective gas, arranging the heated roughed strip storage device immediately adjacent a front of the finishing train, and setting the capacity of the heated roughed strip storage device in accordance with the exit speed of the finished strip from the finishing train and a time needed to perform said step of welding.

5. The process of claim 1, wherein said step of rolling the roughed strip lengths in six passes comprises rolling the roughed strip lengths to a thickness of 3 mm.

6. The process of claim 1, further comprising the steps of designing the casting capacity of the casting machine and the rolling capacities of the roughing and finishing trains so that continuous operation of the finishing train without interruption is ensured.

* * * * *